United States Patent [19]

Van Diest

[11] Patent Number: 5,028,005

[45] Date of Patent: Jul. 2, 1991

[54] SPRING LOADED WATER IRRIGATION RISER SYSTEM

[76] Inventor: Anthony Van Diest, 8850 Paseo St., Paramount, Calif. 90723

[21] Appl. No.: 582,390

[22] Filed: Sep. 10, 1990

[51] Int. Cl.[5] ..... B05B 15/10

[52] U.S. Cl. ..... 239/205; 239/570

[58] Field of Search ..... 137/508; 239/570, 571, 239/203-206

[56] References Cited

U.S. PATENT DOCUMENTS

| | | | |
|---|---|---|---|
| 3,033,467 | 5/1962 | Hofer | 239/571 X |
| 3,539,112 | 11/1970 | Thompson | 239/570 X |
| 3,782,410 | 1/1974 | Steuby | 137/508 X |
| 4,036,435 | 4/1977 | Pecaro | 239/570 X |
| 4,084,749 | 4/1978 | Drori | 239/571 X |
| 4,361,280 | 11/1982 | Rosenberg | 239/570 X |
| 4,655,245 | 4/1987 | Gellerson | 137/508 X |
| 4,753,391 | 6/1988 | Rogers | 239/200 X |

FOREIGN PATENT DOCUMENTS

| | | | |
|---|---|---|---|
| 2103759 | 2/1972 | Fed. Rep. of Germany | 239/570 |

*Primary Examiner*—Andres Kashnikow

*Assistant Examiner*—Kevin Weldon

*Attorney, Agent, or Firm*—Charles H. Thomas

[57] ABSTRACT

A cylinder and piston assembly for a retracting sprinkler head is buried well below ground surface of an area to be irrigated. The piston has an elongated, tubular sprinkler riser pipe extending upwardly from an upright cylinder having upper and lower water supply ports. The piston and the riser pipe are forced upwardly by water under pressure supplied to the cylinder through the lower water port. The piston is of annular configuration and is reciprocally movable relative to the lower end of the riser pipe between upper and lower stops secured to the riser pipe within the cylinder. A coil spring is compressed between the piston and the upper stop to urge the piston downwardly into sealing engagement against the lower stop, thereby isolating a radial port in the wall of the riser pipe from water under pressure at the lower end of the cylinder. As water enters the lower end of the cylinder the piston and riser pipe are raised together until the upper stop reaches the upper end of the cylinder. Only then does the water pressure overcome the bias of the spring, thereby allowing water to enter the riser pipe.

10 Claims, 1 Drawing Sheet

SPRING LOADED WATER IRRIGATION RISER SYSTEM

BACKGROUND OF THE INVENTION

1. Field of the Invention

The present invention relates to an irrigation system with sprinkler heads which are capable of being drawn below ground surface when not in use.

2. Description of the Prior Art

In the past, the irrigation of agricultural fields, golf courses and lawns has either been carried out by fixed installations that are at least partially located at the ground surface of a field or movable systems that are supported on the ground. However, fixed installations interfere with the mowing, plowing and cultivating of the fields, fairways or lawns on which they are located. Movable irrigation systems, on the other hand present a nuisance in that they have to be broken down and set up at regular intervals.

In my U.S. Pat. No. 3,752,403 I disclosed a sprinkler system that is buried well below the ground surface so that the system does not interfere with mowing, plowing and cultivating operations. The system uses a plurality of cylinder and piston assemblies which are disposed vertically upright under the ground. Each sprinkler riser pipe in that system is secured to a piston and extends upwardly through a central opening in the upper end wall of a cylinder. A suitable sprinkler head that is capable of piercing through the ground is fixed to the upper end of the riser pipe.

Pressurized water directed into a lower port in the lower end of the cylinder urges the piston, the riser pipe, and the sprinkler head upwardly together, whereby the sprinkler head breaks up through the surface of the soil and is capable of watering a large area. The riser pipe and sprinkler head are retracted back beneath the surface of the soil by relieving water pressure from the lower cylinder part and supplying water pressure to the upper cylinder port to force the piston downwardly toward the bottom of the cylinder and draw the riser pipe and sprinkler head back well below ground level.

After using the system a few years I have discovered that although it works, it wastes water in that whenever the piston starts to move upwardly, water commences to flow immediately and continuously up through the riser pipe and out of the sprinkler head. The premature ejection of water while the riser pipe is moving upwardly causes excessive and wasteful watering in the immediate vicinity of the sprinkler head. Furthermore, the ejection of the water from the sprinkler head as it rises upwardly through the soil creates significant erosion in the area immediately above the cylinder.

SUMMARY OF THE INVENTION

The present invention involves the use of a novel cylinder and piston assembly adapted for use in a buried irrigation system, such as that described in my aforementioned U.S. Pat. No. 3,752,403. The piston in this improved system includes a slidably disposed cylindrical annular piston head with an axially disposed hole therewithin. A hollow riser pipe extends through the axial hole in the piston in sliding arrangement herewith The riser pipe also extends upwardly through the upper end wall of the cylinder. A standard packing gland is disposed about the riser pipe and is mounted at the upper end wall of the cylinder to prevent leakage. The piston can move reciprocally along the surface of the wall of the riser pipe between upper and lower stops that are secured to that lower portion of the riser pipe which always resides within the confines of the cylinder.

The upper stop is preferably formed as an annular sleeve secured to the exterior surface of the wall of the riser pipe. The sleeve preferably has an outer diameter greater than the diameter of the axial opening in the upper end wall of the cylinder. The lower stop may take the form of a cap at the lower extremity of the riser pipe. Such a cap not only provides a lower stop for the piston, but also serves to plug the central axial duct of the riser pipe at the lower extremity thereof. The stop may also include an annular flange disposed directly above the cap at the lower extremity of the riser pipe.

Preferably, a water impervious, resilient annular sealing ring is disposed atop the flange. A spring is disposed about the wall of the riser pipe and is deployed in a compressed condition between the upper stop and the piston. The spring thereby urges the piston downwardly toward the lower stop. In the absence of sufficient water pressure in the lower portion of the cylinder the spring is strong enough to force the piston into liquid tight sealing engagement with the sealing ring located above the lower stop.

At least one radially extending hole is formed in the wall of the riser pipe just above its lower extremity. When the water pressure urges the riser pipe and piston upwardly, the upper stop makes contact with the upper end wall of the cylinder. The riser pipe thereupon stops moving but water pressure within the lower portion of the cylinder continues to force the piston upwardly. The pressure of the water overcomes the spring bias and further compresses the spring as it forces the piston upwardly along the riser pipe. As the piston is forced upwardly away from the lower stop the radially disposed hole or holes in the riser pipe are exposed so that water is then free to flow radially into the riser pipe, axially through the central duct defined therein, and up and out of the top of the riser pipe.

In one broad aspect the present invention may be considered to be an improvement for a buried water irrigation system in which an upright, hollow sprinkler riser pipe extends upwardly from an upright cylinder which is buried in soil. In the system the riser pipe is raised and lowered by a piston that moves within the cylinder between upper and lower water ports in the cylinder. According to the improvement of the invention upper and lower stops are secured to the riser pipe within the cylinder above and below the piston. The piston has an annular configuration and is reciprocally movable along the riser pipe between the upper and lower stops. The riser pipe has at least one radial port located above and proximate to the lower stop. A means is provided for sealing the lower extremity of the riser pipe, and a compressed spring is disposed between the upper stop and the piston.

The lower stop preferably has an annular configuration. A resilient water impervious ring is disposed atop the lower stop and encircles the riser pipe. The spring is preferably a helical wire coil spring that bears against both the upper stop and the piston.

In another broad aspect the invention may be considered to be an improved irrigation device having an upright cylinder with upper and lower water ports buried in soil, a piston reciprocal in the cylinder between the upper and lower water ports, and a tubular upright sprinkler riser pipe having a wall defining a duct therewithin coupled to the cylinder and movable in vertical reciprocation by the piston. According to the improvement of the invention the piston is of annular configuration and is reciprocally movable relative to the riser pipe along the wall thereof. The lower extremity of the riser pipe duct is sealed and at least one radial port is defined through the wall of the riser pipe to provide a flow path to the riser pipe duct. Upper and lower stops are secured to the riser pipe within the cylinder above and below the piston. A spring is compressed between the piston and the upper stop to urge the piston toward the lower stop. Preferably, a liquid tight seal is formed when the piston is pressed against the lower stop.

The invention may be described with greater clarity and particularity with reference to the accompanying drawings.

DESCRIPTION OF THE EMBODIMENT

Figure 1:
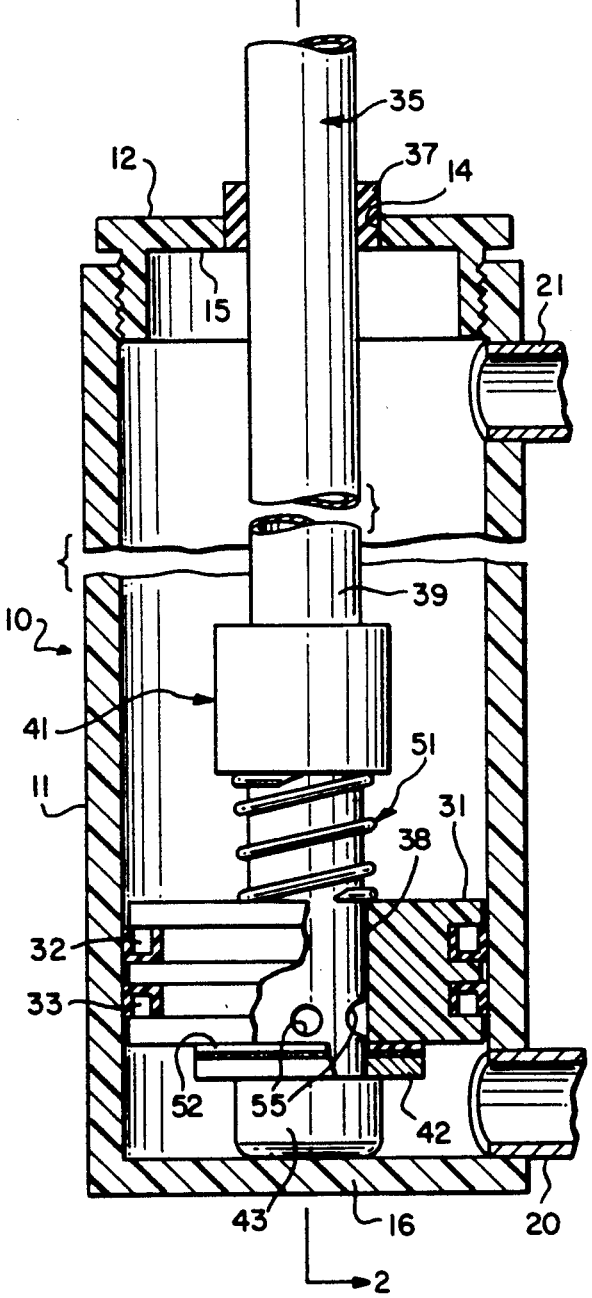
FIG. 1 is a cross section of my improved piston and cylinder assembly deployed in an irrigation system such as that described in my earlier U.S. Pat. No. 3,752,403, showing the piston in its lowermost position.

As illustrated in the drawings, each cylinder 10 has a tubular shell 11 with a closed or blind end formed by a lower end wall 16 and an interiorally threaded mouth at its upper end. The mouth is closed by an externally threaded plastic plug 12 which forms an upper end wall 15 with an axially disposed opening 14 therein. Near the lower end wall 16 of the cylinder 10 there is a radially directed lower water supply port in which a tube 20 is suitably coupled. Near the upper end of the cylinder shell 11 another tube 21 is suitably coupled in an upper radially directed water supply port in the cylinder shell 11.

Slidably disposed within each cylinder 10 is an annular piston 31 which has a pair of radial annular grooves in its outer surface. Suitable standard sealing rings 32 and 33 are disposed in these grooves. The sealing rings 32 and 33 and the grooves in which they are disposed are well known in the art. The piston 31 also has an axial passageway 38 extending therethrough.

Axially disposed within the cylinder 10 is an upright, hollow, tubular plastic riser pipe 35 which is similar in construction to my elongated member 24 (taught in my above mentioned patent). The riser pipe 35 slidably passes through opening 14 in the upper end wall of the cylinder 10 formed by the threaded plug 12. A standard sealing and packing gland 37 is installed in the opening 14 in the plug 12 to prevent leakage. At the upper end of the riser pipe 35 (not shown) is mounted the spray or sprinkler heads (as taught in my above mentioned patent). The lower end of the riser pipe 35 freely passes through the axial passageway 38 in the piston 31.

Located above and below the piston 31 and secured to the riser pipe 35 are upper and lower stops. The upper stop 41 is formed as a cylindrical annular sleeve secured by adhesive to the outer wall 39 of the riser pipe 35. A suitable cap 43 is used to seal the opening in the lower end of the internal axial duct formed within the annular wall 39 of the riser pipe 35. Above the cap 43 there is an annular plastic flange 42. The cap 43 and the flange 42 are both secured by adhesive to the lower extremity of the riser pipe 35. The cap 43 and the flange 42 together serve as a lower stop that limits downward movement of the piston 31. A resilient, annular, water impermeable rubber sealing ring 52 is disposed atop and bonded to the flange 42.

A helical wire coil stainless steel spring 51 encircles the wall 39 of the riser pipe 35 and resides in a condition compressed at all times between the upper stop 41 and the piston 31. The riser pipe 35 is provided with one or more radially directed holes forming ports 55 defined through the riser pipe wall 39 proximate to and immediately above the lower extremity of the riser pipe 35. The ports 35, under certain conditions, provide a path of liquid flow from the water supply tube 20 through the lower portion o the cavity within the cylinder 10 to the central axial duct of the riser pipe 35. In the absence of sufficient water pressure from the tube 20, however, the coil spring 51 is strong enough to press the piston 31 downwardly against the sealing ring 52 to form a liquid tight seal therewith, thereby cutting off any flow of water into the central axial duct of the riser pipe 35.

When water pressure is provided through the water supply tube 20, on the other hand, the riser pipe 35 and the piston 31 are forced upwardly together until the upper stop 41 is halted in abutment against the upper end wall 15 of the cylinder 10 formed by the plug 12. The water pressure from the tube 20 is sufficiently strong to continue forcing the piston 31 upwardly, however, further compressing the coil spring 51 and exposing the ports 55 in the wall 39 of the riser pipe 35. Water can thereupon flow from the lower portion of the cylinder 10 radially inwardly through the ports 55 and up into the central axial duct of the riser pipe 35 as long as sufficient water pressure is maintained from the tube 20.

In operation pressurized water is admitted through tube 20 by suitable means (not shown but clearly described in my above patent) and tube 21 is suitably opened to the atmosphere or some other low pressure region. Any water which may be on the upper side of the cylinder 10 is vented out of tube 21.

The difference in pressure across the piston 31 causes the piston 31 to rise. In so doing the riser pipe 35 and the sprinkler head (not shown but as mentioned is attached to the top) rise until the sprinkler head breaks through the ground. Due to the force of the spring 51, the ports 55 are blocked by the body of the piston 31 while the riser pipe 35 travels upwardly. Therefore, no water flows up the riser pipe 35 and out of the sprinkler head as the piston 31 is rising. This result is obtained because the force necessary to compress the coil spring 51 is greater than the friction force which prevents the sprinkler from rising through the soil. If by chance, in application, a friction force greater than the spring force were to develop, the spring 51 would be compressed thereby exposing radial ports 55. Water would then be able to flow out of the sprinkler head. In this event the friction force would dramatically decrease, allowing the sprinkler head to rise and again shutting off the flow of water through ports 55.

Figure 2:
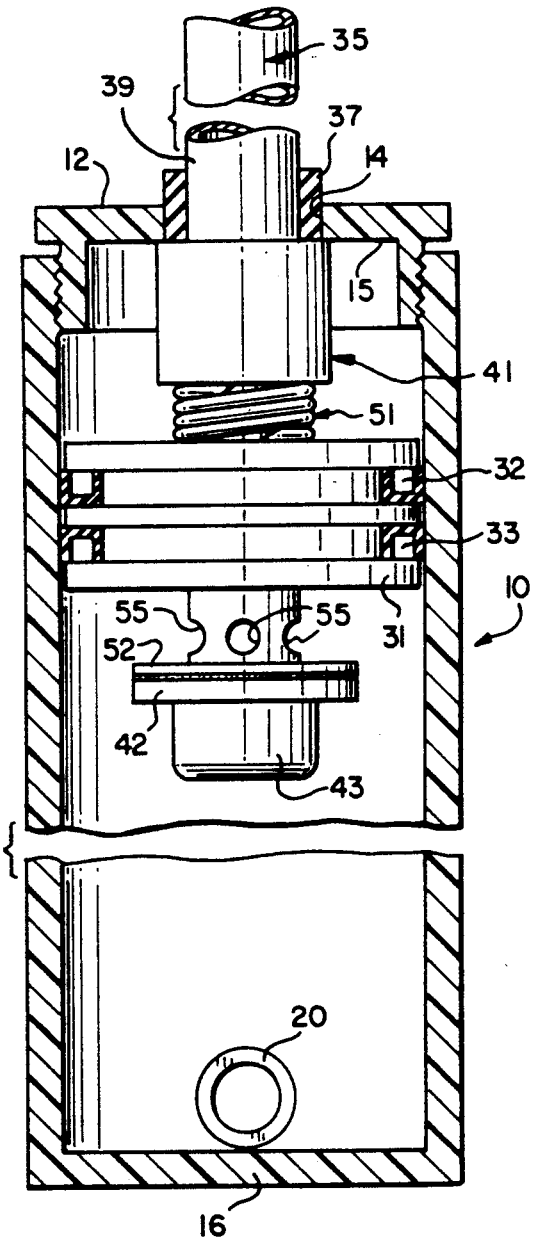
FIG. 2 is an elevational sectional view taken along the lines 2—2 of FIG. 1 showing the piston in its uppermost position near the upper end of the cylinder.

When the piston 31 nears the top of the cylinder 10, the sleeve forming the upper stop 41 ultimately makes contact with the upper cylinder end wall 15 formed by the plug 12 as shown in FIG. 2. The water pressure in tube 20 is such that the spring 51 is thereupon axially compressed to further expose the ports 55. Water then flows through the ports 55 and up through the axial duct of the riser pipe 35 to irrigate the field, fairway or lawn.

When the irrigation is completed the pressurized water source is coupled to tube 21 and tube 20 is vented. The piston 31 is thereupon forced downwardly, thereby bringing down the sprinkler head with it Because there is little if any water pressure in the lower portion of the cylinder 10 as the riser pipe 35 and piston 31 descend, the spring 51 holds the piston 31 against the sealing ring 52 to prevent water from flowing out of the sprinkler head as the sprinkler head is retracted.

Undoubtedly, numerous variations and modifications of the invention will become readily apparent to those familiar with buried water irrigation systems. For example, different spring arrangements may be substituted for the helical wire coil spring 51. Also, it may be advisable to provide the piston 31 with an annular gasket on its internal surface to prevent flow of water through the axial passageway 38 therethrough. Also, such an annular radial gasket, if positioned near the lower extremity of the axial passageway 38 of the piston 31, could simultaneously perform the function of the annular sealing ring 52. Accordingly, the scope of the invention should not be construed as limited to the specific embodiment and the manner of implementation described herein, but rather is defined in the claims appended hereto.

I claim:

1. In an irrigation system employing an upright cylinder buried beneath soil to be irrigated and coupled t a water source and having upper and lower water supply ports leading to said water source and in which a piston is disposed for reciprocation within said cylinder and including a hollow, elongated, tubular water riser pipe extending upwardly from said piston and passing upwardly through said cylinder, the improvement wherein said riser pipe passes axially through said piston in sliding engagement therewith and has at least one radial port defined therein proximate its lower extremity, and further comprising a lower stop secured to the lower extremity of said riser pipe and extending radially outwardly therefrom, an upper stop located above said piston and secured to said riser pipe and extending radially outwardly therefrom, and a compressed spring located between said upper stop and said piston and acting to urge said piston downwardly on said riser pipe toward said lower stop.

2. An irrigation system according to claim 1 wherein said spring is a wire, coil spring.

3. An irrigation system according to claim 1 wherein said lower stop has an annular configuration and further comprising a water impermeable resilient ring disposed atop said lower stop.

4. An irrigation system according to claim 1 wherein said upper water supply port is a radial port in the wall of said cylinder located beneath the upper extremity of said cylinder, and said upper stop is a sleeve secured to the outside of said riser pipe and having a length greater than the distance between said upper water supply port and said upper extremity of said cylinder.

5. An improvement for a buried water irrigation system in which an upright hollow sprinkler riser pipe extends upwardly from an upright cylinder which is buried in soil and is raised and lowered by a piston that moves within said cylinder between upper and lower water ports in said cylinder comprising: upper and lower stops secured to said riser pipe within said cylinder above and below said piston, wherein said piston is of an annular configuration and is reciprocally movable along said riser pipe between said upper and lower stops and wherein said riser pipe has at least one radial port located above and proximate to said lower stop, means sealing the lower extremity of said riser pipe, and a compressed spring disposed between said upper stop and said piston.

6. The improvement according to claim 5 wherein said lower stop has an annular configuration and further comprising a resilient, water impervious ring disposed atop said lower stop and encircling said riser pipe.

7. The improvement according to claim 5 wherein said spring is a wire coil spring bearing against said upper stop and said piston.

8. In an irrigation system having a upright cylinder with upper and lower water ports buried in soil, a piston reciprocal within said cylinder between said upper and lower water ports, and a tubular upright sprinkler riser pipe having a wall defining a duct therewithin coupled to said cylinder and movable in vertical reciprocation by said piston, the improvement wherein said piston is of annular configuration and is reciprocally movable relative to said riser pipe along said wall thereof and wherein the lower extremity of said riser pipe is sealed and further comprising a radial port defined through said wall of said riser pipe to provide a flow path to said riser pipe, upper and lower stops secured to said riser pipe within said cylinder above and below said piston, and a spring compressed between said piston and said upper stop to urge said piston toward said lower stop.

9. An improved irrigation device according to claim 8 further comprising means for forming a liquid tight seal between said piston and said lower stop when said piston is pressed against said lower stop.

10. An improved irrigation device according to claim 8 wherein said spring is a wire helical coil spring disposed about said wall of said riser pipe.

* * * * *